US011833714B2

(12) United States Patent
Chavez

(10) Patent No.: US 11,833,714 B2
(45) Date of Patent: Dec. 5, 2023

(54) MOBILE CONTINUOUS MIXING APPARATUS WITH LINEARLY ALIGNED FEED BELTS

(71) Applicant: Tirso Chavez, Lowell, MA (US)

(72) Inventor: Tirso Chavez, Lowell, MA (US)

( * ) Notice: Subject to any disclaimer, the term of this patent is extended or adjusted under 35 U.S.C. 154(b) by 0 days.

(21) Appl. No.: 17/999,456

(22) PCT Filed: Jun. 11, 2021

(86) PCT No.: PCT/US2021/070699

§ 371 (c)(1),
(2) Date: Nov. 21, 2022

(87) PCT Pub. No.: WO2021/253052

PCT Pub. Date: Dec. 16, 2021

(65) Prior Publication Data

US 2023/0191659 A1 Jun. 22, 2023

Related U.S. Application Data

(60) Provisional application No. 63/038,180, filed on Jun. 12, 2020.

(51) Int. Cl.

| | |
|---|---|
| ***B28C 9/04*** | (2006.01) |
| ***B28C 5/12*** | (2006.01) |
| ***B28C 7/10*** | (2006.01) |

(52) U.S. Cl.

CPC ..... *B28C 9/0463* (2013.01); *B28C 5/1246* (2013.01); *B28C 5/1253* (2013.01); *B28C 7/10* (2013.01)

(58) Field of Classification Search

CPC ... B28C 9/0463; B28C 5/1246; B28C 5/1253; B28C 7/10

See application file for complete search history.

(56) References Cited

U.S. PATENT DOCUMENTS

| | | | | |
|---|---|---|---|---|
| 3,456,925 A | | 7/1969 | Gallagher | |
| 3,917,236 A | | 11/1975 | Hanson | |
| 4,219,279 A | * | 8/1980 | Haws | B60P 1/40 366/35 |
| 4,298,288 A | * | 11/1981 | Weisbrod | B28C 9/0454 366/11 |

(Continued)

FOREIGN PATENT DOCUMENTS

| | | |
|---|---|---|
| DE | 3419997 A1 | 8/1985 |
| EP | 0270202 A1 | 6/1988 |
| FR | 2222844 A | 10/1974 |

*Primary Examiner* — Charles Cooley

(57) ABSTRACT

A continuous mixer that is installed in the bed of a dump truck. The mixer has a hopper for cement, a pair of belts to move the other mixing materials, and a chute with an auger for mixing the cement and mixing materials with water and depositing the mixture where desired. The hopper stands upright in the bed when the bed is down and tilted at about 45° when the bed is up. An auger at the bottom of the hopper feeds cement to an opening at the bottom of the hopper, The belts sit below the hopper and are oriented with the belts parallel to the ground during operation, The belts feed mixing materials from the bed to a mixing chute below the belts. An auger combines the dry materials and water to form the concrete as they travel the length of the chute to the discharge end.

11 Claims, 19 Drawing Sheets

(56) References Cited

U.S. PATENT DOCUMENTS 4,406,548 A 9/1983 Haws
4,441,821 A * 4/1984 Burkhart ..... B28C 9/0463 193/15
4,538,916 A * 9/1985 Zimmerman ..... B28C 9/0463 366/186
4,548,507 A * 10/1985 Mathis ..... B28C 9/00 366/186
4,579,459 A * 4/1986 Zimmerman ..... B28C 9/0463 366/186
4,601,629 A * 7/1986 Zimmerman ..... B28C 9/0463 414/528
4,624,575 A * 11/1986 Lantz ..... B28C 9/0463 366/38
4,781,466 A * 11/1988 Zimmerman ..... B28C 9/0463 366/50
4,922,463 A * 5/1990 Del Zotto ..... B28C 9/0463 366/186
5,044,819 A * 9/1991 Kilheffer ..... E01C 19/46 366/156.1
5,354,127 A * 10/1994 Del Zotto ..... B01F 27/725 366/186
5,375,925 A 12/1994 Elkin
5,486,047 A * 1/1996 Zimmerman ..... B28C 9/0463 198/860.3
5,551,776 A * 9/1996 Zimmerman ..... B28C 5/4251 193/6
5,590,976 A * 1/1997 Kilheffer ..... G01G 19/08 366/8
5,624,183 A * 4/1997 Schuff ..... B28C 7/06 366/35
5,785,420 A * 7/1998 Schuff ..... B28C 5/142 366/35
5,893,639 A * 4/1999 Tetoldini ..... B28C 9/0463 366/50
6,241,076 B1 6/2001 Maguire
9,909,398 B2 * 3/2018 Pham ..... B65G 65/46
2006/0233040 A1 10/2006 Cessti et al.
2007/0226089 A1 * 9/2007 DeGaray ..... G06Q 10/087 705/28
2009/0171595 A1 * 7/2009 Bonilla Benegas .... B28C 5/422 702/41
2009/0177313 A1 * 7/2009 Heller ..... B28C 9/049 700/214
2009/0180348 A1 * 7/2009 Long, Jr. ..... B28C 9/0463 366/8
2010/0135101 A1 * 6/2010 Lepper ..... B28C 7/0413 141/250
2012/0205400 A1 * 8/2012 Degaray ..... B28C 7/064 222/192
2013/0025706 A1 * 1/2013 Degaray ..... B28C 7/0422 406/108
2013/0199617 A1 * 8/2013 Degaray ..... B28C 9/0454 137/1
2015/0165393 A1 * 6/2015 Schuster ..... B28C 7/12 366/1
2017/0021529 A1 * 1/2017 Cunningham ..... B28C 7/044
2017/0080601 A1 * 3/2017 Hernandez ..... B28C 7/0418
2017/0369258 A1 * 12/2017 Degaray ..... B28C 7/0418
2018/0347214 A1 * 12/2018 Degaray ..... B28C 7/044
2020/0276731 A1 * 9/2020 Igo ..... B28C 9/0454
2021/0229322 A1 * 7/2021 Johnson ..... B28C 9/0409
2021/0332584 A1 * 10/2021 Johnson ..... E04B 1/3431
2022/0297346 A1 * 9/2022 Johnson ..... B28C 5/0818
2023/0120412 A1 * 4/2023 Strong ..... E04G 21/0436 137/351
2023/0191659 A1 * 6/2023 Chavez ..... B28C 5/1253 366/32

* cited by examiner

MOBILE CONTINUOUS MIXING APPARATUS WITH LINEARLY ALIGNED FEED BELTS

BACKGROUND OF THE INVENTION

Field of the Invention

The present invention relates to concrete mixing apparatus and more particularly, to a mobile concrete mixing apparatus for mounting on a dump truck or trailer.

The Prior Art

The prior art teaches a number of different truck-mounted mobile mixers. They have a number of shortcomings. The truck is dedicated to the mixer, that is, when the mixer is not needed, the truck cannot be used for anything else.

The boxes of the prior art mixers are V-shaped. They are wide at the top and taper downwardly towards the belt or auger for discharge. As a result, the trucks are top heavy with a high center of gravity, making them dangerous in the road.

The material transport mechanisms for moving the materials to the back of the truck for mixing, whether they are belts or augers, are long, typically stretching the entire length of the box, 16 to 18 feet. Because they are so long, everything associated with the material transport needs to be heavy duty, including the sprockets, chains, bearings, hydraulics, etc. They are subject to more wear and tear. It also means that the truck burns more fuel.

Belts and augers that extend the length of the box are more dangerous, increasing the chance of injury.

Because materials are being transported from farther away in the truck, the mixing is harder to start.

Augers and belts get stuck quite often, especially when the material has been sitting for a while. This is due, in part, to the sand being compacted at the bottom from the motion of the truck on the road during transport.

Manufactured sand is next to impossible to move using a long auger. It constantly gets stuck. This happens more often in very cold weather because any moisture in the sand freezes, somewhat solidifying the sand. Further, the V-shape at the bottom is more exposed to the elements and therefore freezes faster than the rest of the sand. The current solution is to spray the sand with calcium chloride, but this degrades the quality of the concrete. Another solution is to use electric heating rods, which consume a lot of energy and are not very efficient.

SUMMARY OF THE INVENTION

The present invention continuous mixer that can be installed in the bed of a standard dump truck in place of the truck's tailgate. The mixer uses the truck bed for some of the material to be mixed, such as sand and gravel. The mixer has a cement hopper for holding the cement, a pair of belts for moving the mixing materials from the truck bed, and a chute for mixing the cement and mixing materials with water and for depositing the mixture where desired.

The hopper stands generally upright in the truck bed when the bed is down and tilted at about 45° when the bed is tilted up. If the hopper is a narrower than the bed, optional spacers can be installed to fill the gap and prevent side-to-side movement of the mixer.

The hopper has a top hatch for filling the hopper with cement. The hatch cover is attached by hinges and optionally includes a gasket to keep moisture out.

The hopper has a hopper auger assembly at the bottom of the hopper that feeds cement to a hopper opening at the bottom center of the hopper. Gravity feeds the cement to the auger assembly. Optionally, the center of the hopper auger assembly is covered with a pipe to prevent the cement from flowing out of the hopper opening when the mixer is not in operation.

The pair of feed belts within a housing sit below the hopper. The left belt extends horizontally between an outer end below the hopper left side wall to an inner end at the hopper opening. The right belt extends horizontally between an outer end below the hopper right side wall to an inner end at the hopper opening. A gap separates the belts.

Each belt is a continuous band of robust, flexible material that loops around rollers. The bands have lateral cleats to help pull the material. The belts are oriented at an angle, typically about 90°, to the bottom of the hopper so that the belts are generally parallel to the ground during operation. The top of the belt housing is open to the truck bed and the mixing materials are pushed onto the belts by gravity. The belts feed the mixing materials to the gap where they fall to a feed opening in the bottom wall of the housing. Optionally, the amount of the mixing material reaching the gap is controlled by limiting gates in gate walls built like a pyramid over the gap.

Below the belt housing is a mixing chute. The chute has an elongated, U-shaped trough and a flat ceiling with a pivot end and a discharge end. The chute is mounted to pivot at the pivot end vertically between a storage position, where the discharge end of the chute is higher than the pivot end, and a discharge position, where the discharge end is at or lower than the pivot end. In the present design, a hydraulic piston moves the chute.

An inlet at the pivot end is vertically aligned with the feed opening. The hopper auger assembly feeds cement into the hopper opening where it falls into the feed opening, and the feed belts feed the mixing materials into the feed opening. These dry materials drop through the feed opening into the chute feed inlet.

A mixing auger extends through the trough and combines the dry materials and water to form the concrete as they travel the length of the chute to the discharge end. Water is added by a water inlet to the chute at a distance of about ¼ the length of the mixing auger from the pivot end to permit the dry materials to be mixed before the water is added.

The hopper auger assembly, feed belts, and mixing auger are driven by drive mechanisms. The hopper auger assembly and feed belts are driven by a motor that directly drives the feed belts and that drives a drive belt or chain to rotate the hopper auger assembly. The mixing auger is driven by a motor, preferably mounted at the discharge end of the chute.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention, shown in FIGS. 1-10, is a mostly self-contained continuous mixer 10 that can be installed in and removed from the bed 3 of a standard dump truck 2. A dump truck 2 raises the truck bed 3 by hydraulic pistons from a down position, where the bed 3 is horizontal, to an up position, where the bed 3 slants downwardly from the front to the back of the truck 2, at a desired angle of as much as 50°.

Figure 4:
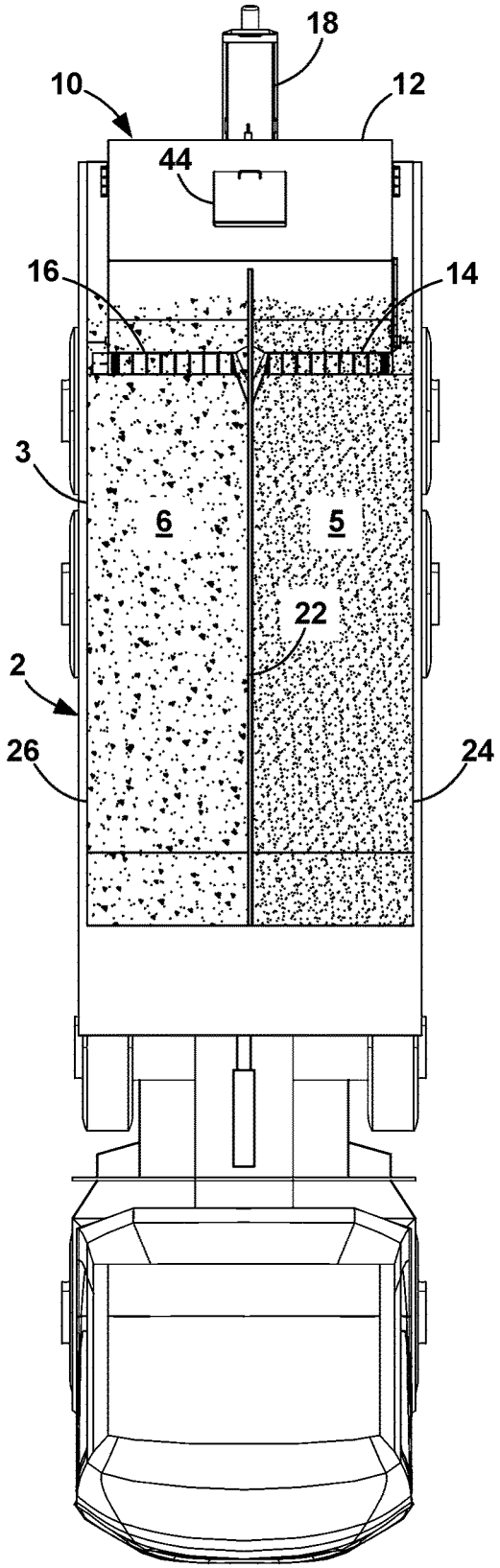
FIG. 4 is a top view of the mixer installed in a dump truck bed with mixing materials.

The mixer 10 uses the truck bed 3 for some of the material 5, 6 to be mixed. For example, when making concrete, the truck bed 3 holds sand 5 and gravel 6, as shown in FIG. 4. When making gunite, the truck bed 3 holds sand 5. The details of how the materials 5, 6 are held in the bed 3 are described below.

In the present specification, the directions "left" and "right" are used as viewed from the back of the truck 2. The terms "front" and "back" are relative to the back of the truck 2. In other words, when looking at the mixer 10 from the back of the truck 2, the front is closest to the viewer.

The mixer 10 has a cement hopper 12 for holding the cement 4, a pair of belts 14, 16 for moving the mixing materials 5, 6 from the truck bed 3, and a chute 18 in which the cement 4 and mixing materials 5, 6 are mixed with water by an auger 150 and for depositing the concrete mixture 7 where desired.

Because cement 4 is adversely affected by moisture, the cement hopper 12 is enclosed to keep most moisture out for at least the amount of time that the cement 4 will be in the hopper 12 prior to mixing.

Figure 2:
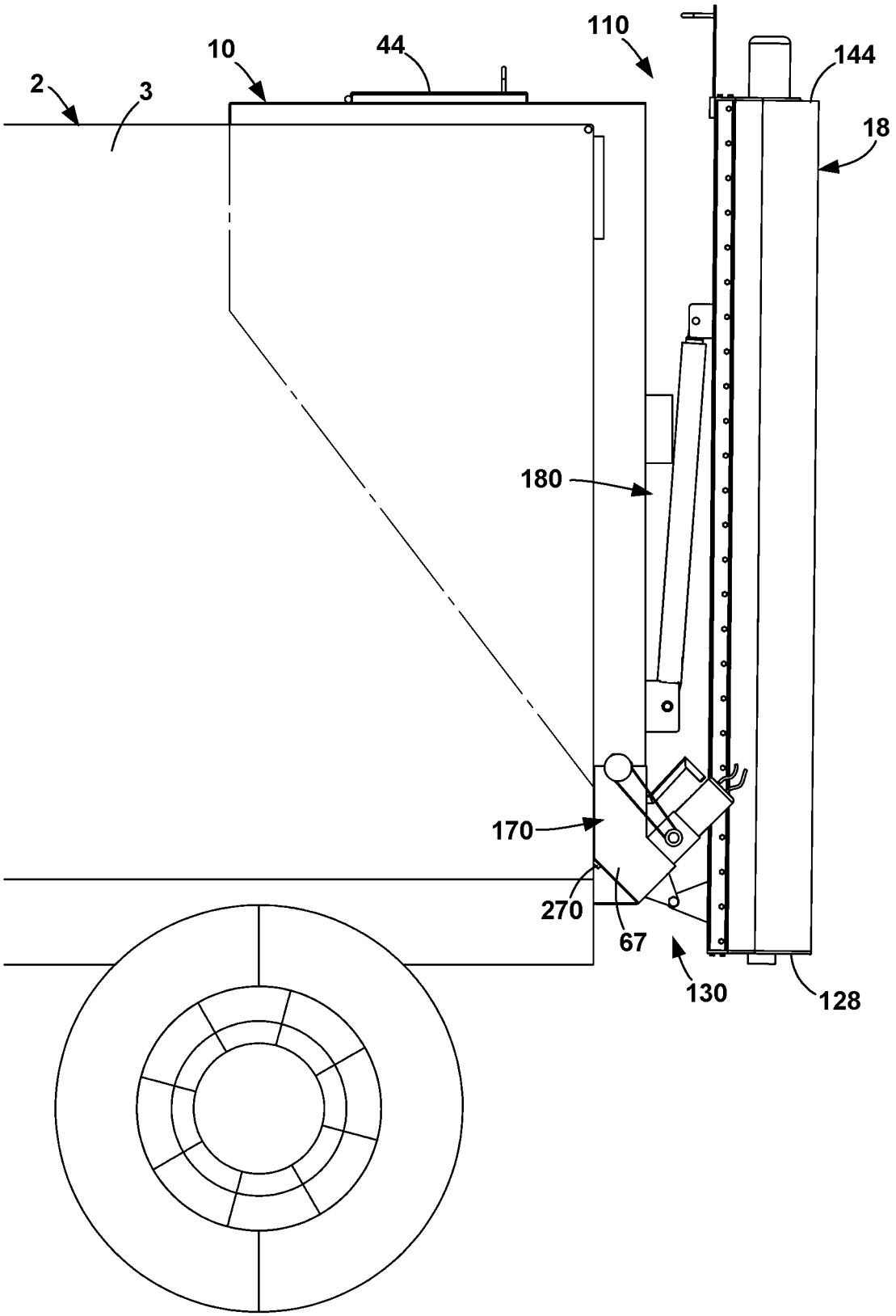
FIG. 2 is a side, partial phantom view of the mixer installed in a dump truck bed in the transport/storage position.

As shown in FIG. 2, the hopper 12 stands generally upright in the transport orientation when the bed 3 is down. The hopper 12 is tilted in the operating orientation when the bed 3 is tilted up, as in FIG. 5.

Figure 6:
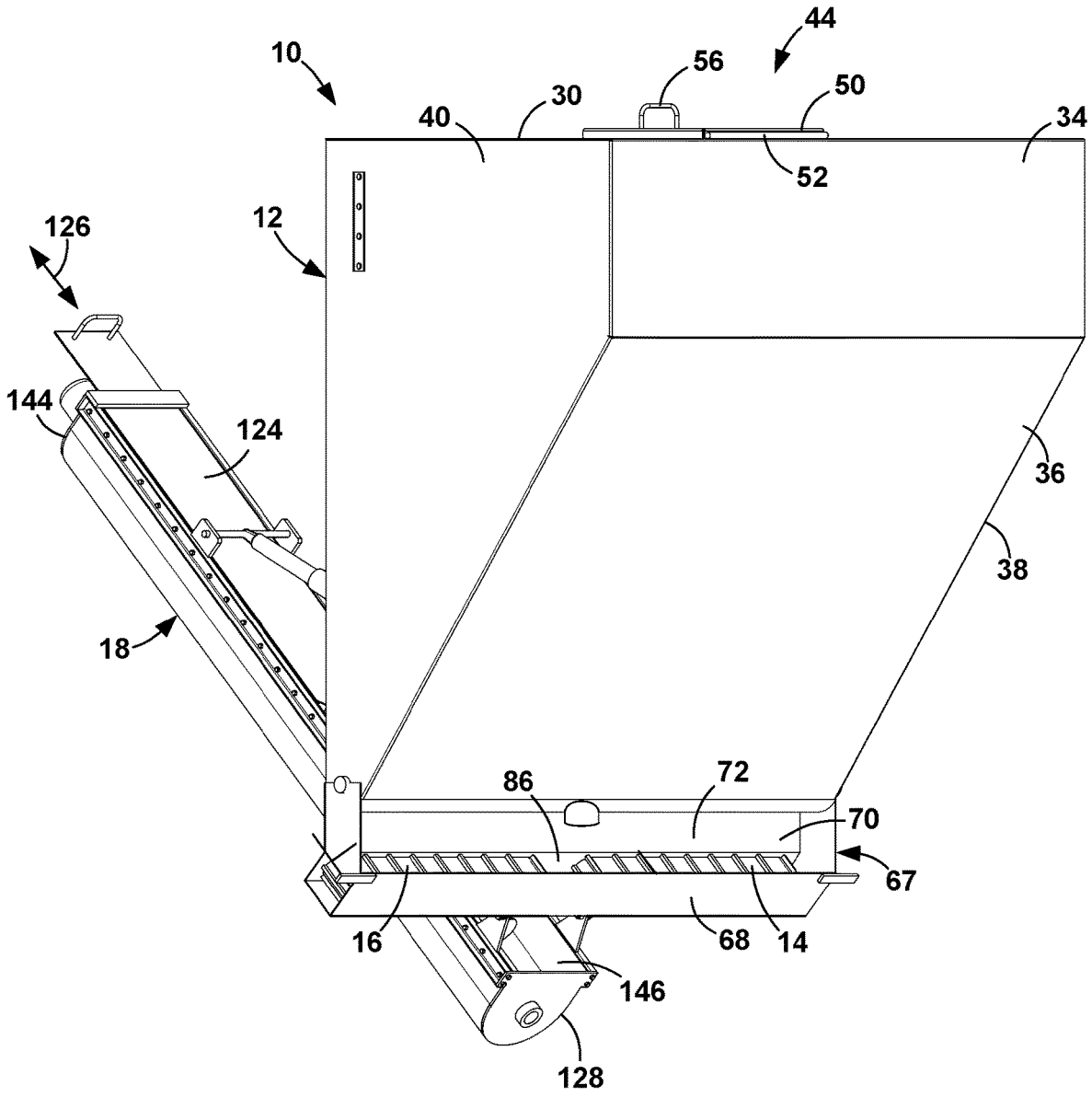
FIG. 6 is a back, perspective view of the mixer.
Figure 7:
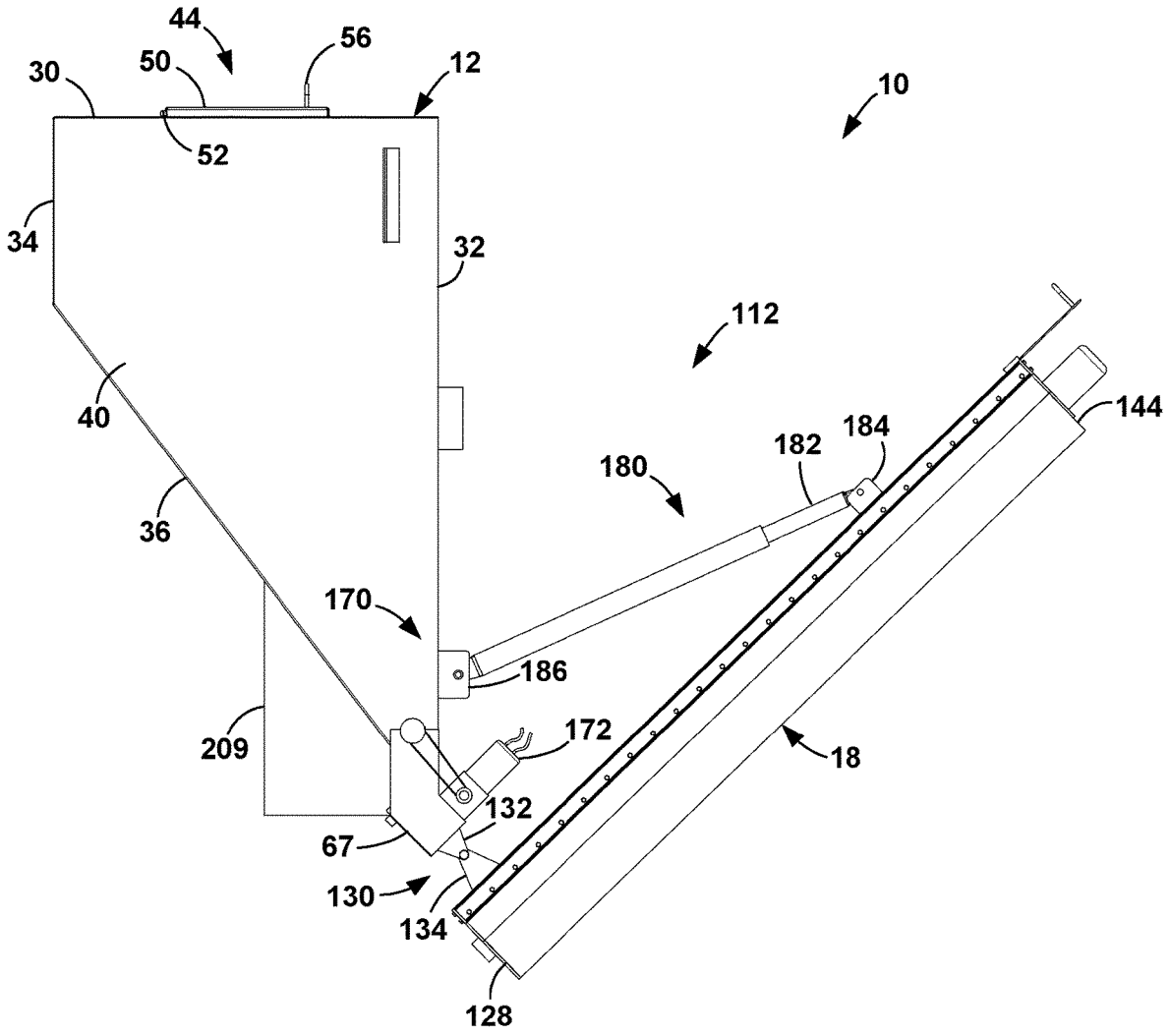
FIG. 7 is a left-side view of the mixer.
Figure 8:
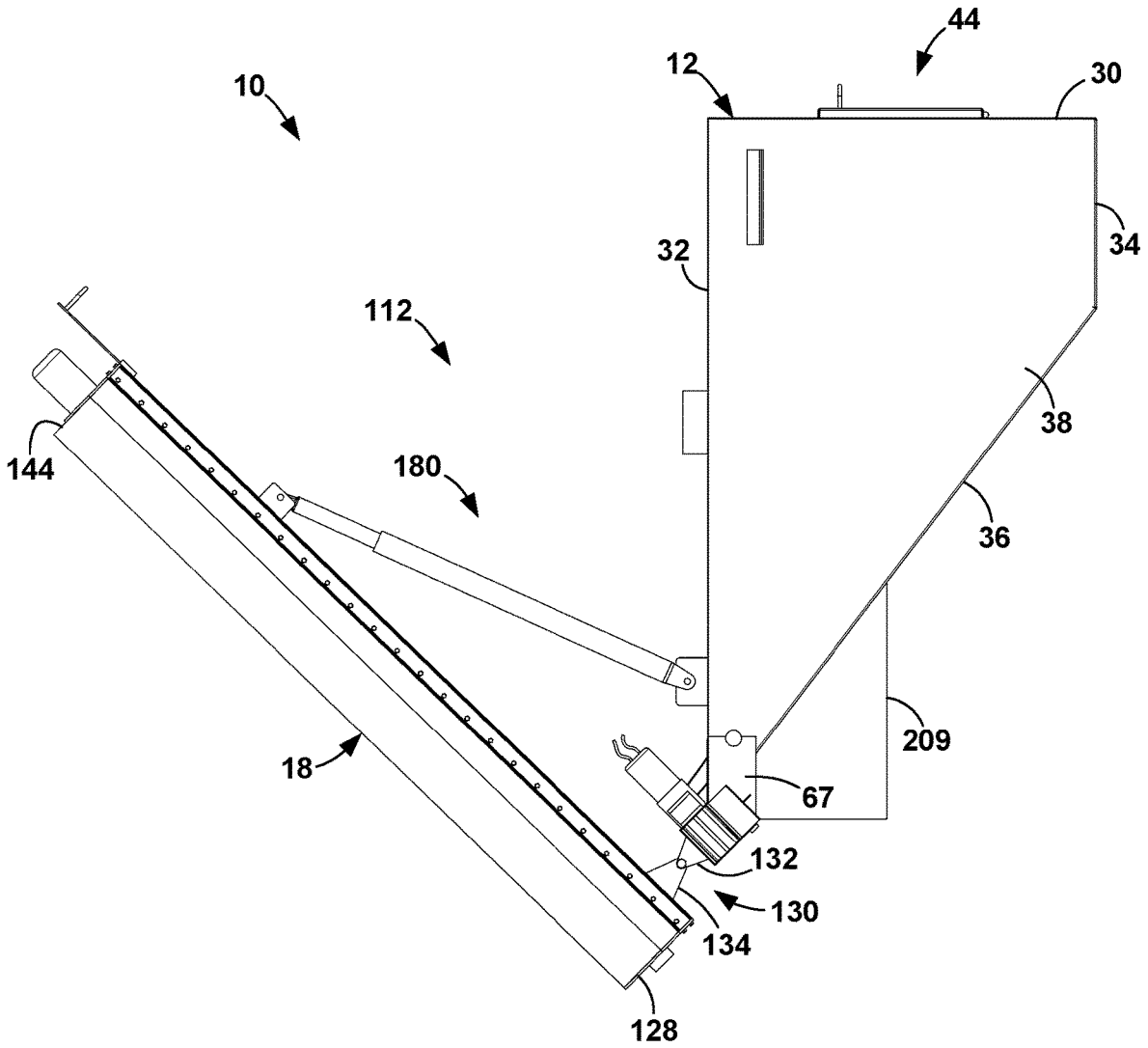
FIG. 8 is a right-side view of the mixer with the chute in the discharge position.

As shown in FIGS. 6 and 7, the top wall 30 is rectangular and horizontal. The front wall 32 is generally rectangular and vertical and extends down to the bottom of the hopper 12. The back wall 34 is generally rectangular, is within about 10° of vertical, and only extends a short distance toward the bottom of the hopper 12. The bottom wall 36 is sloped at an angle in the range of from about 30° to 45°, preferably about 38°, from the bottom of the front wall 34 to the bottom of the hopper 12. The right-side wall 38 and the left-side wall 40 are shaped to complement the front, back, top, and bottom walls and are vertical. For the design illustrated in the present specification, the dimensions of the hopper 12 are such that the hopper 12 holds approximately 4 cubic yards. The actual dimensions are determined by the particular application.

In general, the width (side to side) of the hopper 12 is a bit narrower than the width of the truck bed 3 so that it is relatively easy to mount and dismount without needing perfect alignment. The sides of the truck bed 3 are used to prevent side-to-side movement of the mixer 10 when installed in the bed 3. If the hopper 12 is narrower than the truck bed 3, optional spacers 286, shown in FIG. 10, can be installed to fill the gap 284 and prevent side-to-side movement of the mixer 10.

The manner by which the mixer 10 is mounted in the truck bed 3 is described below.

Figure 11:
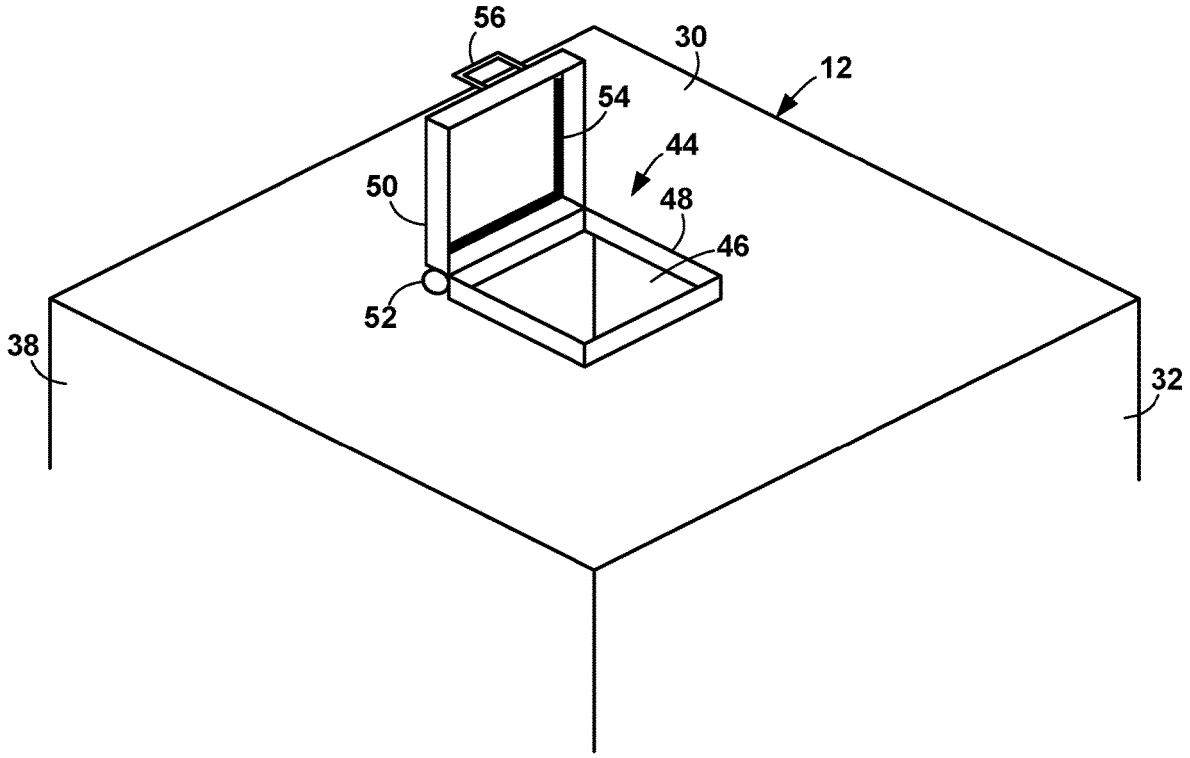
FIG. 11 is a detail, perspective view of the hopper hatch with the cover open.

As shown in FIG. 11, the hopper 12 has a top hatch 44 in the top wall 30 for filling the hopper 12 with cement 4. The hatch 44 has an opening 46, typically square or round, with a raised lip 48. The hatch cover 50 is attached by hinges 52. Optionally, the hatch cover 50 is lined with a gasket material 54, such as rubber, so that when the hatch cover 50 is closed, most moisture is kept out of the hopper 12. A handle 56 facilitates opening the hatch cover 50. Optionally, the hatch 44 includes a latch to secure the hatch cover 50 closed.

Figure 12:
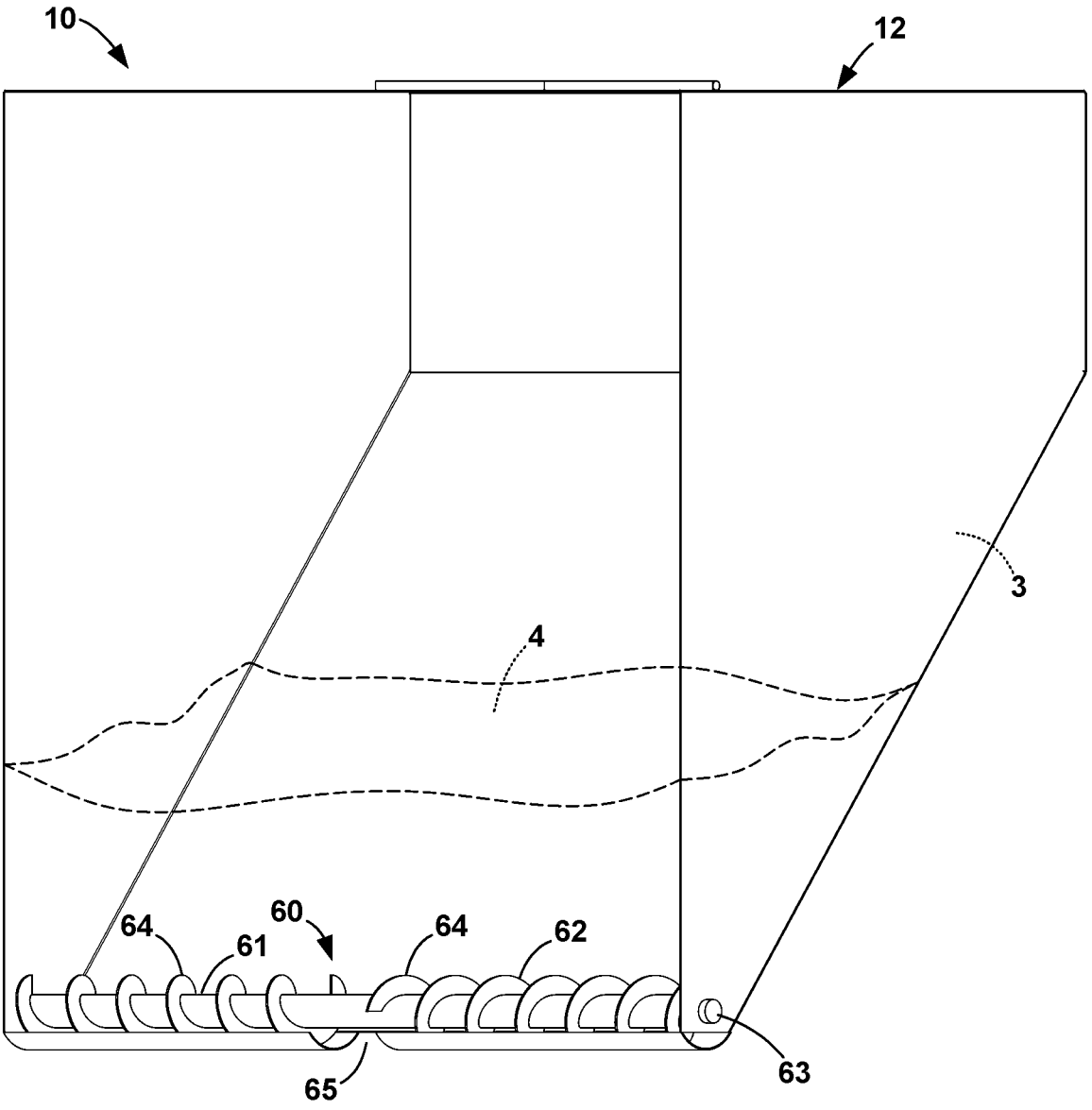
FIG. 12 is a front, perspective, cutaway view of the hopper with the hopper augers.
Figure 13:
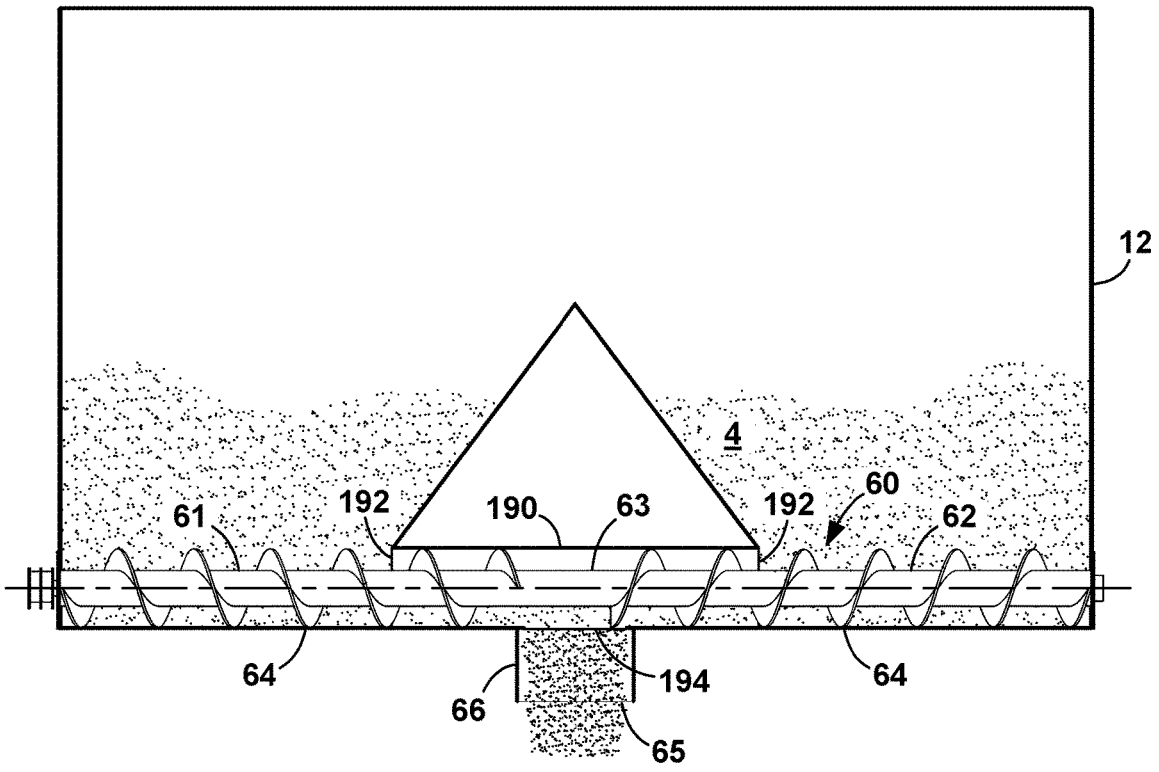
FIG. 13 is a front, cutaway view of the hopper with the hopper augers.

As shown in FIGS. 12 and 13, the hopper 12 has a hopper auger assembly 60 at the bottom of the hopper 12 that feeds cement 4 to a hopper opening 65 at the bottom center of the bottom wall 36. Gravity feeds the cement 4 from the hopper 12 to the auger assembly 60. The auger assembly 60 has a left auger 61 and a right auger 62. The two augers 61, 62 can be configured with a pair of separate, coaxial shafts 63, each with a blade 64, or a single shaft 63 and two blades 64.

In the first configuration of the hopper auger assembly 60 with separate, coaxial shafts 63, the shafts 63 can be rotated independently of each other. One advantage to this arrangement is that the two augers 61, 62 can be rotated at different speeds if desired. Another advantage is that the two augers 61, 62 can be identical, that is, with the same clockwise or counterclockwise twist, but rotated in opposite directions to move the cement 4 to the hopper opening 65. Since they are identical, only one tool or mold is needed to make both augers 61, 62. The disadvantage to two independent augers 61, 62 is that a more complex mechanism is needed to mount and rotate the augers 61, 62 independently.

In the second configuration of the hopper auger assembly 60, shown in FIGS. 12 and 13, both augers 61, 62 have the same shaft 63, and so rotate in the same direction. Consequently, in order for both augers 61, 62 to move the cement 4 to the hopper opening 65 in the center, the auger blades 64 need have opposite twists with one auger blade 64 having a clockwise twist and the other auger blade 64 having a counterclockwise twist. The mechanism for rotating the augers 61, 62 is much simpler than for two independent augers 61, 62 in that it only has to drive one shaft 63.

In the present design, the shaft 63 has a diameter of 2 to 3 inches, and the blades 64 have a height of 1 to 2 inches, for a total diameter in the range of 4 to 7 inches. The blades 64 have a pitch of about 35°. These dimensions are merely illustrative and can differ for a particular application.

Optionally, to prevent the cement 4 from flowing out of the hopper opening 65 when the mixer 10 is not in operation, the center of the hopper auger assembly 60 is covered with a pipe 190 that fits over the auger assembly 60, as in FIG. 13. The pipe 190 is fixed to the hopper 12 so that it does not rotate and is sized slightly larger than the auger diameter so that the auger assembly 60 can rotate within the pipe 190 without binding. The pipe 190 is open at both ends, as at 192, to allow cement 4 to be pulled into the pipe 190 from the hopper 12 by the auger assembly 60. The pipe 190 has an opening 194 at the center bottom aligned with the hopper opening 65 for the cement 4 to fall through to the hopper opening 65. In the present design, the pipe 190 is about 18 inches long.

Optionally, there is a second blade pitching in the same direction of the main blade 64 for the length of the pipe 190. The two blades prevent the cement 4 from flowing through the pipe 190 when the mixer 10 is not in operation. Optionally, a rubber plug can be installed in the hopper opening 65 to prevent spillage during transportation.

Figure 1:
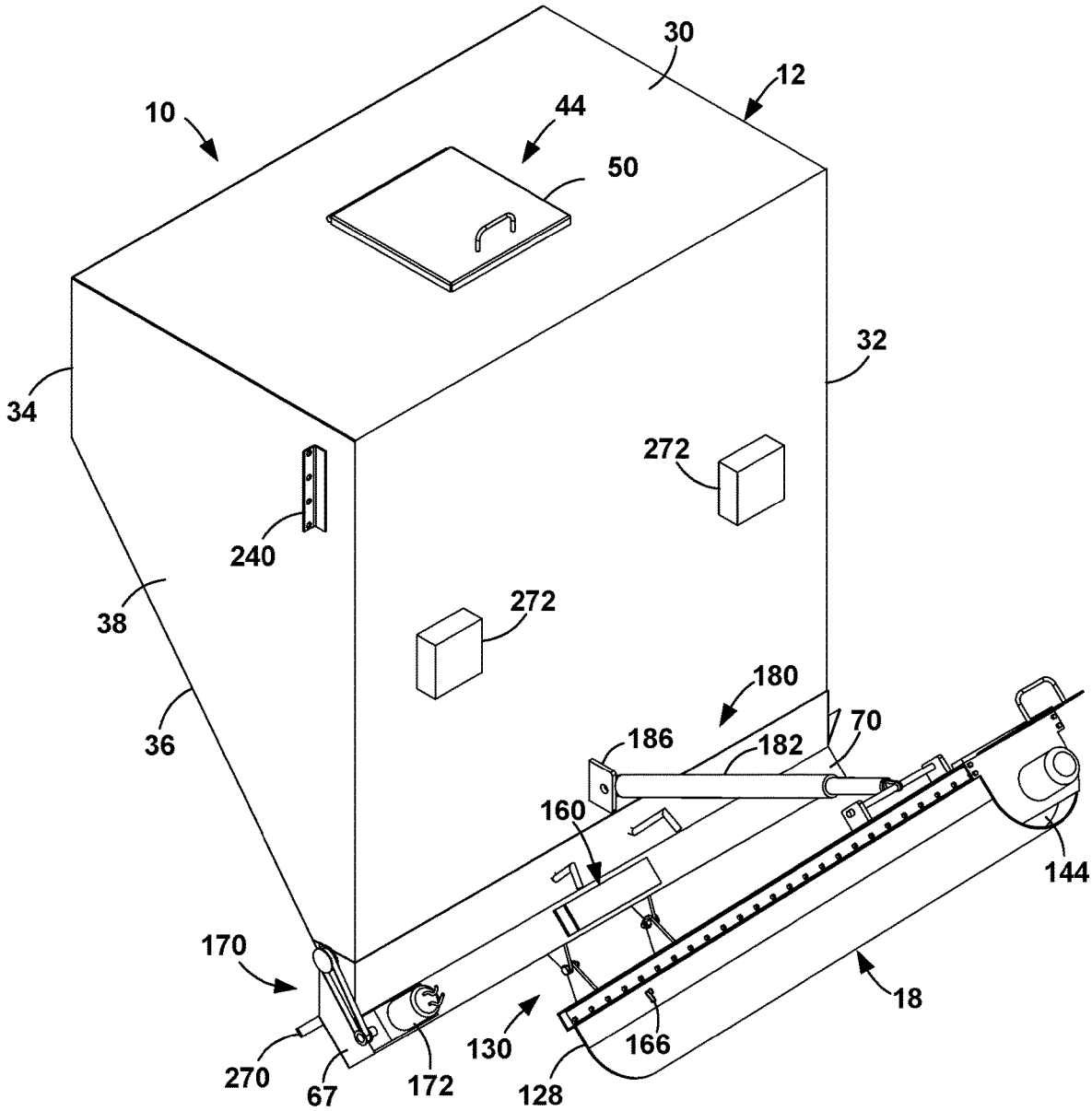
FIG. 1 is a front, perspective view of the mixer of the present invention.

Optionally, one or more vibrators 272 are mounted to the outside of the hopper 12, as shown in FIG. 1. The vibrators 272 can be air powered or hydraulic powered. The vibrators 272 help keep the cement from binding within the hopper 12, thereby maintaining a continuous flow of cement to the hopper auger assembly 60 during operation.

A tube 66 extends between the pipe opening 194 and the hopper opening 65 to guide the cement 4 to the hopper opening 65. Typically, the openings 65, 194 and tube 66 are rectangular or round with a cross-sectional area between 28 (6" round) and 30 (5"×6") square inches. In the present design, the tube 66 is about 6 inches long.

Figure 14:
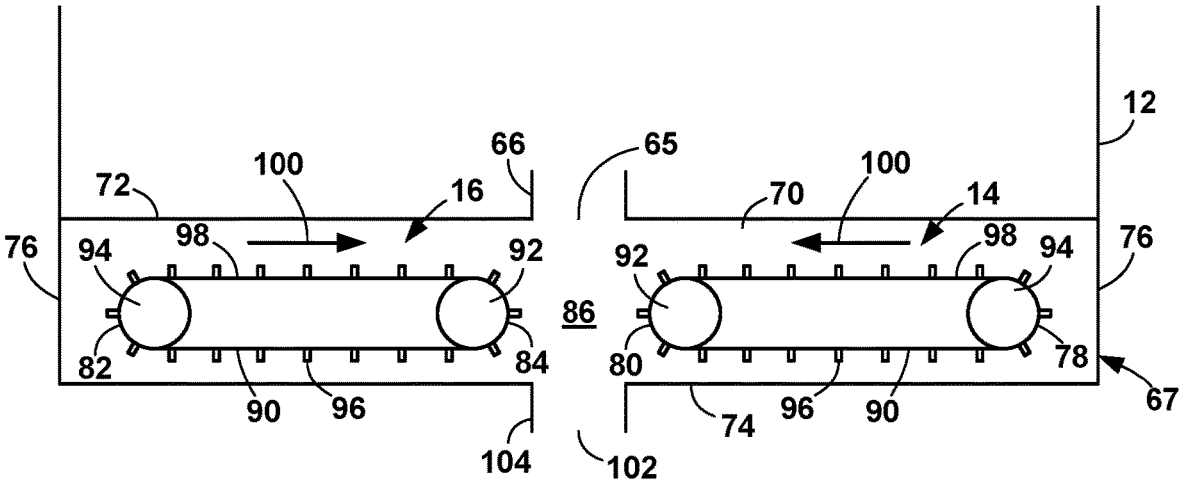
FIG. 14 is a side, cross-sectional view of the feed belts.

Below the hopper 12 is the pair of linearly aligned 14, 16 within a belt housing 67. As shown in FIGS. 6 and 14, the left belt 14 extends horizontally between an outer end 78 below the hopper left side wall 38 to an inner end 80 at the hopper opening 65. The right belt 16 extends horizontally between an outer end 82 below the hopper right side wall 40 to an inner end 84 at the hopper opening 65. A gap 86 separates the inner ends 80, 84 of the belts 14, 16. In the present design, the gap 86 is in the range of from 6 inches to 8 inches.

Each belt 14, 16 has a continuous band 90 of robust, flexible material that loops around an inner roller 92 and an outer roller 94.

In one configuration, the bands 90 are composed of vulcanized rubber with 3 or more plies. The bands 90 have lateral cleats 96 to help the bands 90 pull the material 5, 6. In the present design, the cleats 96 are 1 to 1½ inches high and 6 to 8 inches apart.

Figure 15:
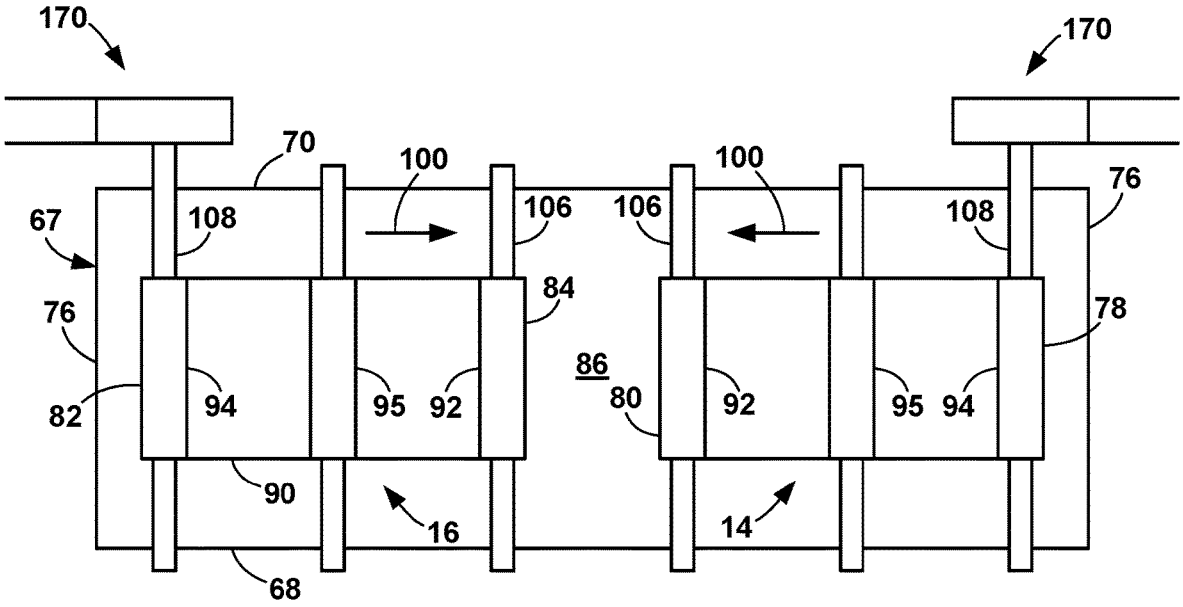
FIG. 15 is a top cross-sectional view of one configuration of the feed belts.
Figure 16:
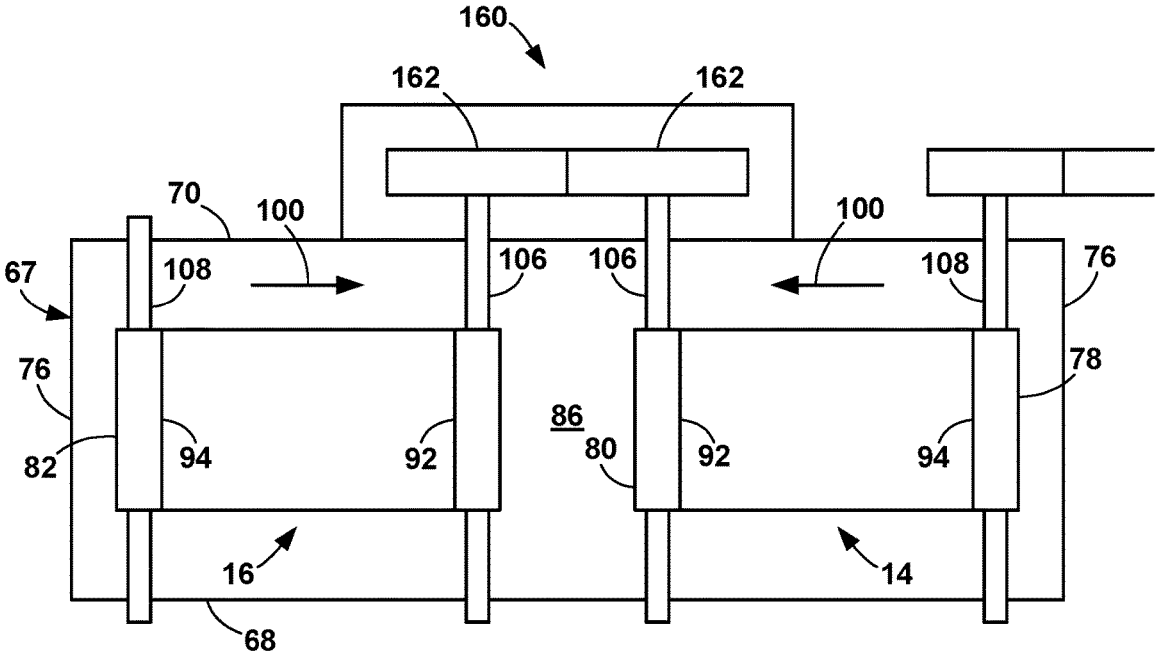
FIG. 16 is a top cross-sectional view of another configuration of the feed belts.

As shown in FIGS. 15 and 16, the inner rollers 92 and the outer rollers 94 are fixed to inner axles 106 and outer axles 108, respectively, that extend between the back wall 68 and the front wall 70 of the housing 67. The axles 106, 108 are mounted to rotate relative to the back wall 68 and the front wall 70. In one configuration, shown in FIG. 15, the outer rollers 94 are separately rotated by a drive mechanism 170 such that the upper section 98 of the belt 14, 16 moves from the outer end 78, 82 to the inner end 80, 84, as at 100.

In another configuration, shown in FIG. 16, the drive mechanism 170 drives only the outer roller 94 of one belt, the left belt 14 in FIG. 16. The other belt 16 is driven by a mechanism 160 that connects the inner roller 92 of the left belt 14 to the inner roller 92 of the right belt 16. The mechanism 160 is typically a pair of meshed gears 162 attached to the rollers 92, or sprockets or pulleys attached to the rollers 92 with a chain or belt connecting them. In this way, the drive mechanism 170 is simplified.

Optional support rollers 95, shown in FIG. 15, between the inner roller 92 and outer roller 94 are mounted between the back wall 68 and the front wall 70 of the housing 67 so that they freely rotate. These support rollers provide additional support to the center of the belts 14, 16.

In another configuration, not shown, the bands 90 are composed of metal chains that drag the materials. The chain has teeth to help the bands 90 pull the materials 5, 6. The chains ride on metal plates between the rollers 92, 94 for support.

The belts 14, 16 are oriented at an angle downwardly, typically about 90°±15°, from the bottom wall 36, as shown in FIG. 6, or 135°±15° downwardly from the front wall 32. In order to operate efficiently, the belts 14, 16 should be generally parallel to the ground during operation, that is, when the truck bed 3 tilted up, as in FIG. 5. So, the angle of the belts 14, 16 to the bottom wall 36 in a particular design of the mixer 10 will depend on the amount the bed 3 of the truck 2 that the particular design will be used can be raised. In the illustrated design, the belts 14, 16 are tilted at an angle in the range of 45°±15° horizontal when the truck bed 3 is down, as in FIG. 2.

The belts 14, 16 are sized as required for the particular application. In the present design, each belt 14, 16 is 35 inches long and 10 inches wide. The rollers 92, 94 are 4 to 5 inches in diameter and spaced approximately 30 inches center-to-center.

The top of the belt housing 67 is open to the truck bed 3, as at 72. The mixing materials 5, 6 are pushed by gravity to the upper section 98 of the belts 14, 16. When the belts 14, 16 are in operation, they feed the mixing materials 5, 6 to the gap 86, where they fall to a feed opening 102 in the bottom wall 74 of the housing 67.

Figure 17:
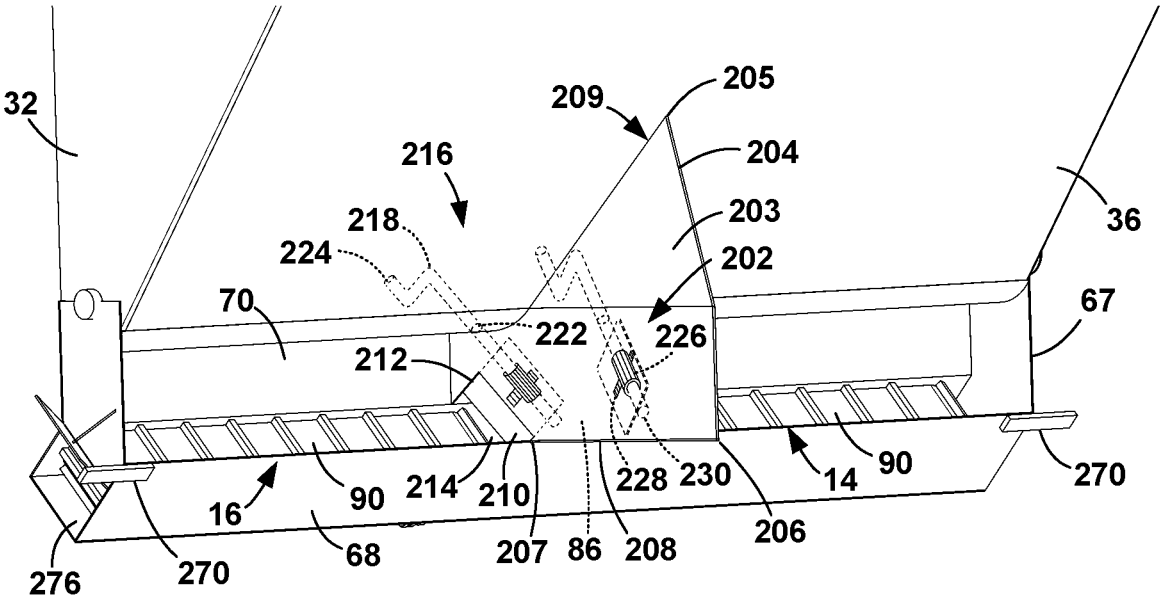
FIG. 17 is a perspective view of the optional material feed gates.

Optionally, the amount of the mixing materials 5, 6 reaching the gap 86 is controlled by limiting gates 202, shown in FIG. 17. Each gate 202 is built into a gate wall 203 that extends outwardly from the hopper bottom wall 36. The outer edges of the gate walls 203 come together at a seam 204 that extends from a point 205 on the hopper bottom wall 36 to a point 206 a distance from the feed belt housing 67, and then separates to two points 207 at the housing back wall 68 that straddle the gap 86. The triangular surface 208 formed by the three points 206, 207 is positioned to rest on the floor of the truck bed, as in FIG. 5. The two walls 203 and the triangular surface 208 form a generally pyramid-shaped cover 209 that covers the gap 86 and feed opening 102 and permits only mixing materials 5, 6 from the feed belts 14, 16 to reach the feed opening 102. The walls 203 slanting from the seam 204 help direct materials 5, 6 to the belts 14, 16.

Each gate 202 includes a door 210 that slides vertically within grooves 212 on the inside of an opening 214 in the gate wall 203. How far the door 210 is open controls the amount of mixing materials 5, 6 that reach the gap 86.

The door 210 is controlled by a gate control mechanism 216. In the present design, shown in FIG. 17, the gate control mechanism 216 includes a crank 218 that extends through a hole 222 in the housing front wall 70. The crank 218 is manually rotated by a handle 224. A pinion 226 on the shaft 230 of the crank 218 meshes with a rack 228 on the door 210. As the crank 218 is rotated, the pinion 226 moves the rack 228, thereby moving the door 210 open or closed. Any acceptable mechanism can be used to convert the rotation of the crank 218 to raise and lower the door 210. Alternatively, the gate control mechanism 216 is operated via a hydraulic or electric motor.

Figure 18:
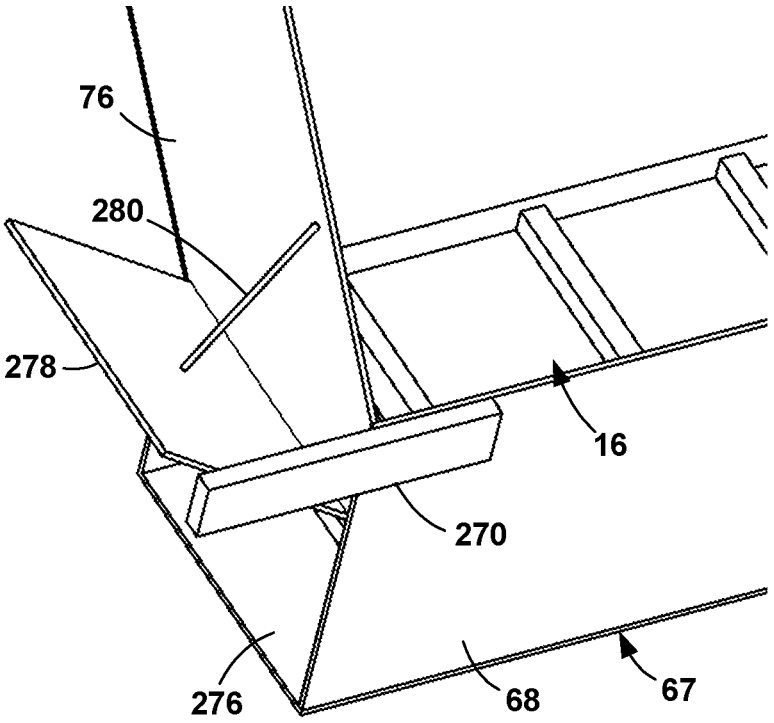
FIG. 18 is a detailed, perspective view of the left belt emptying hatch.

The belt housing 67 includes an optional mechanism for emptying the compartments 24, 26 without mixing the materials 5, 6, shown in FIG. 18. Each end of the housing 67 has a hatch 276. When the belts 90 are run in reverse, that is, away from the gap 86, they move the materials 5, 6 to the hatches 276. Each hatch 276 has a swing-up cover 278 that stays open so that the materials 5, 6 are not blocked from going through the hatches 276. In the present design, chains 280 hold the covers 278 open.

As mentioned above, when mixing concrete, both sand 5 and gravel 6 are mixed with the cement 4, and when mixing gunite, only sand 5 is mixed with the cement 4. When mixing concrete, the truck bed 3 has a barrier 22 that extends front to back through the center and divides the bed 3 into two compartments 24, 26, as shown in FIG. 4. Sand 5 is put in one compartment 24 and gravel 6 is put in the other compartment 26. Either mixing material 5, 6 can be put in either compartment 24, 26. The left belt 14 moves material from the left compartment 24 to the feed opening 102 and the right belt moves material from the right compartment 26 to the feed opening 102.

A tube 104 extends between the gap 86 and the feed opening 102 to guide the mixing materials 5, 6 to the feed opening 102. Typically, the opening 102 and tube 104 are rectangular or round with a cross-sectional area between 78 (10" round) and 100 (10"×10") square inches. In the present design, the tube 104 is about 6 inches long.

Figure 19:
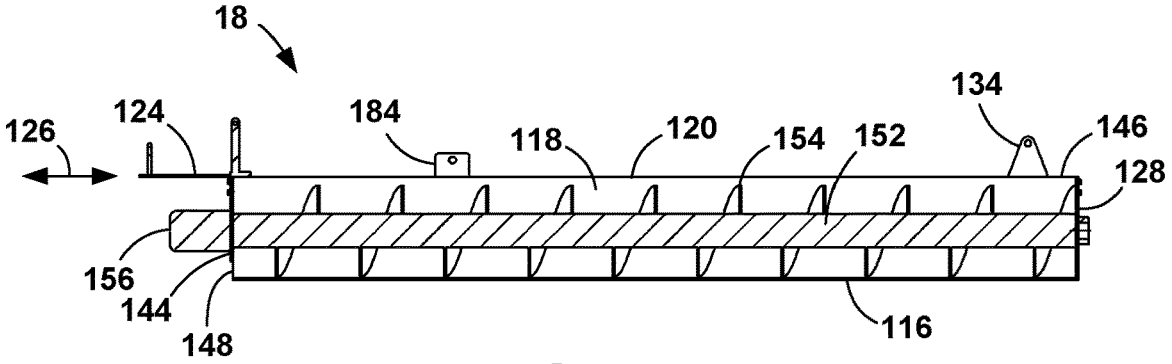
FIG. 19 is a longitudinal cross-sectional view of the chute.

Attached to the belt housing 67 below the feed opening 102 is the pivot end 128 of a mixing chute 18. The chute 18, shown in FIGS. 19-21, has an elongated, U-shaped trough 116 and a flat ceiling 120. The curved bottom of the trough 116 is composed of a heavy duty rubber that is longer-lasting and easier to clean than metal. The chute 18 is typically 7 to 9 feet long. The ceiling 120 provides access to the inside of the chute 18 for cleaning. In one configuration, most of the ceiling 120 is a panel 124 that slides away, as at 126 in FIG. 6, to provide access to the inside of the chute 18.

Figure 3:
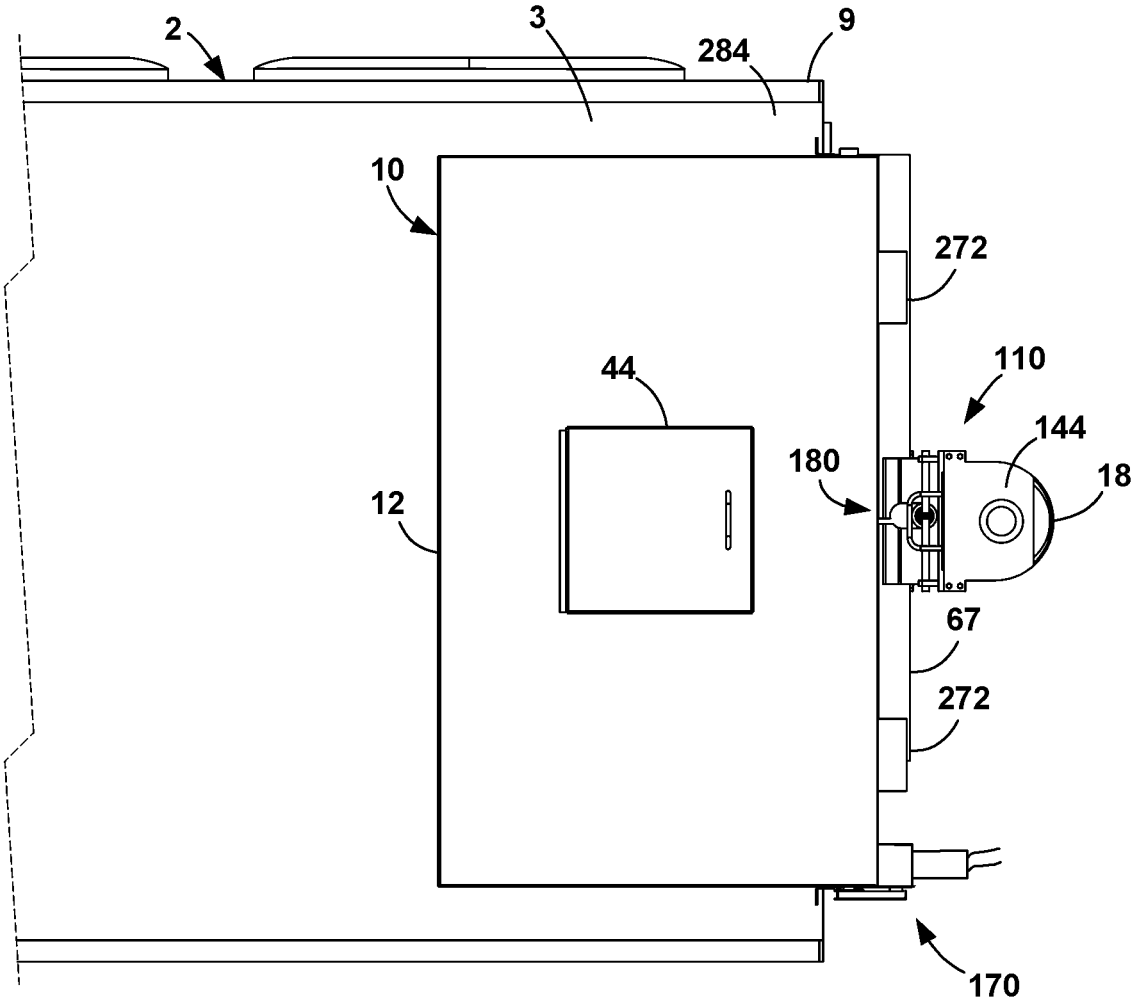
FIG. 3 is a top view of the mixer installed in a dump truck bed in the transport/storage position.
Figure 5:
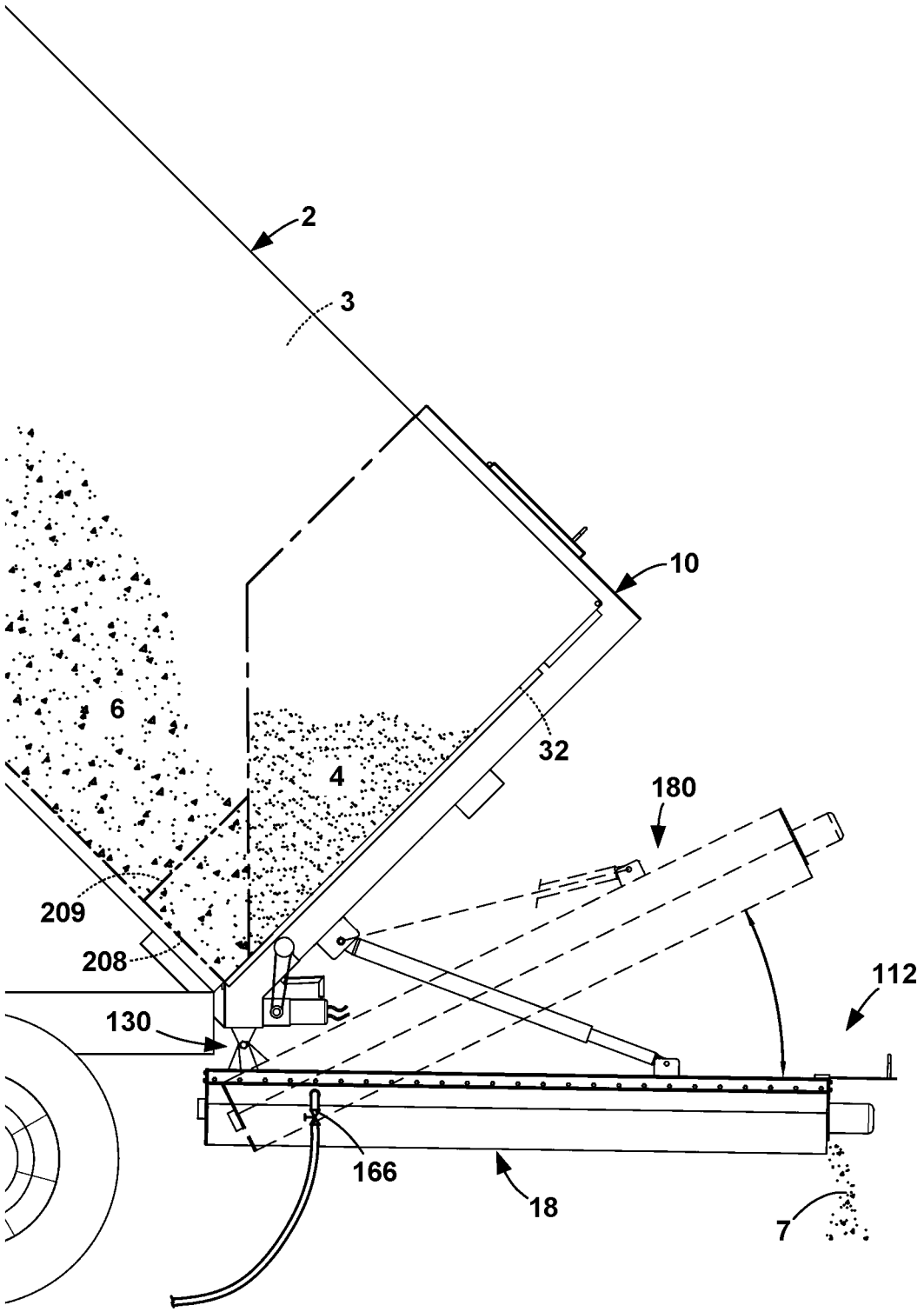
FIG. 5 is a side, partial phantom view of the mixer installed in a dump truck bed in the operating orientation and showing the chute moving to the discharge position.
Figure 9:
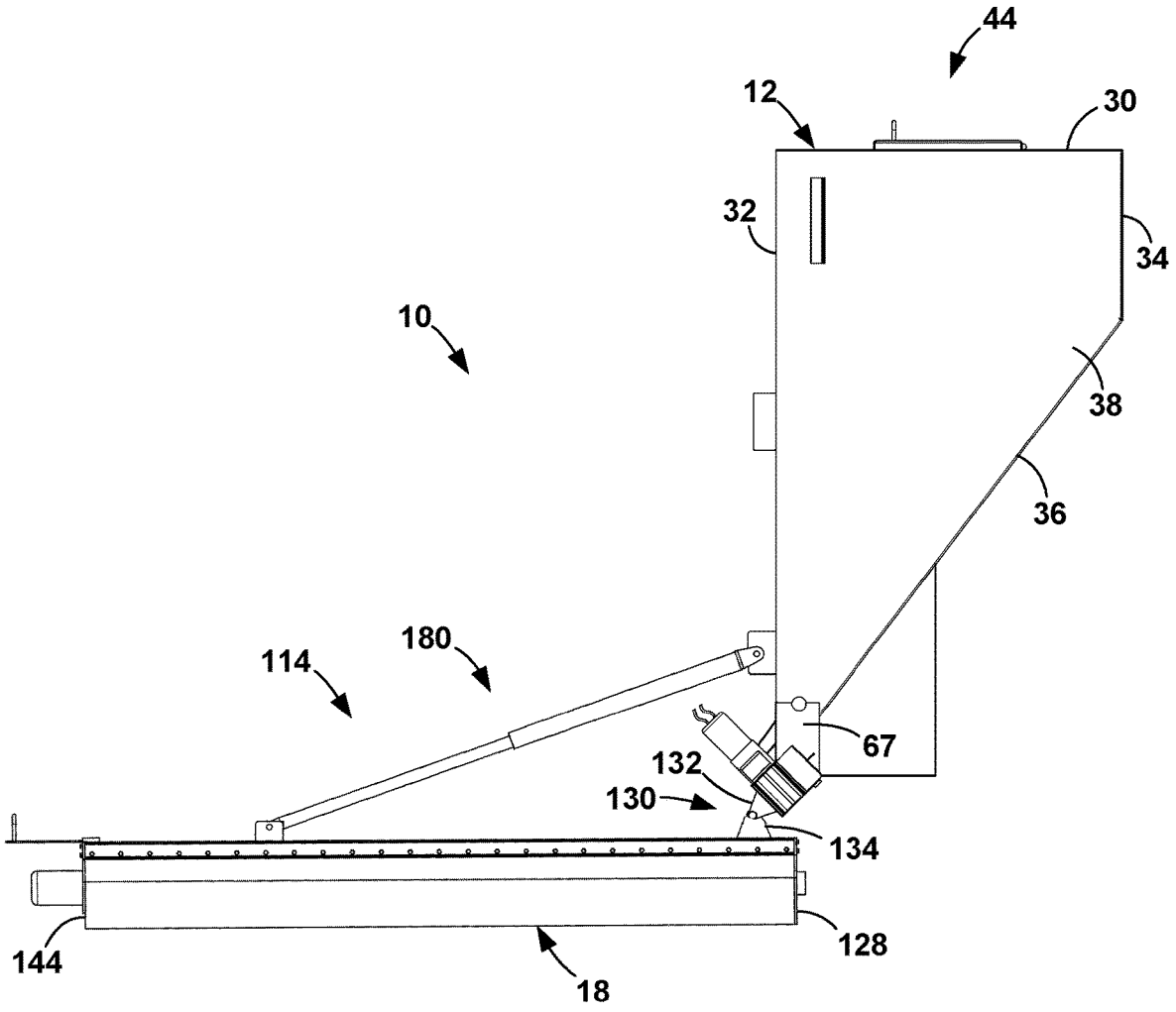
FIG. 9 is a right-side view of the mixer with the chute in the maximum position.
Figure 10:
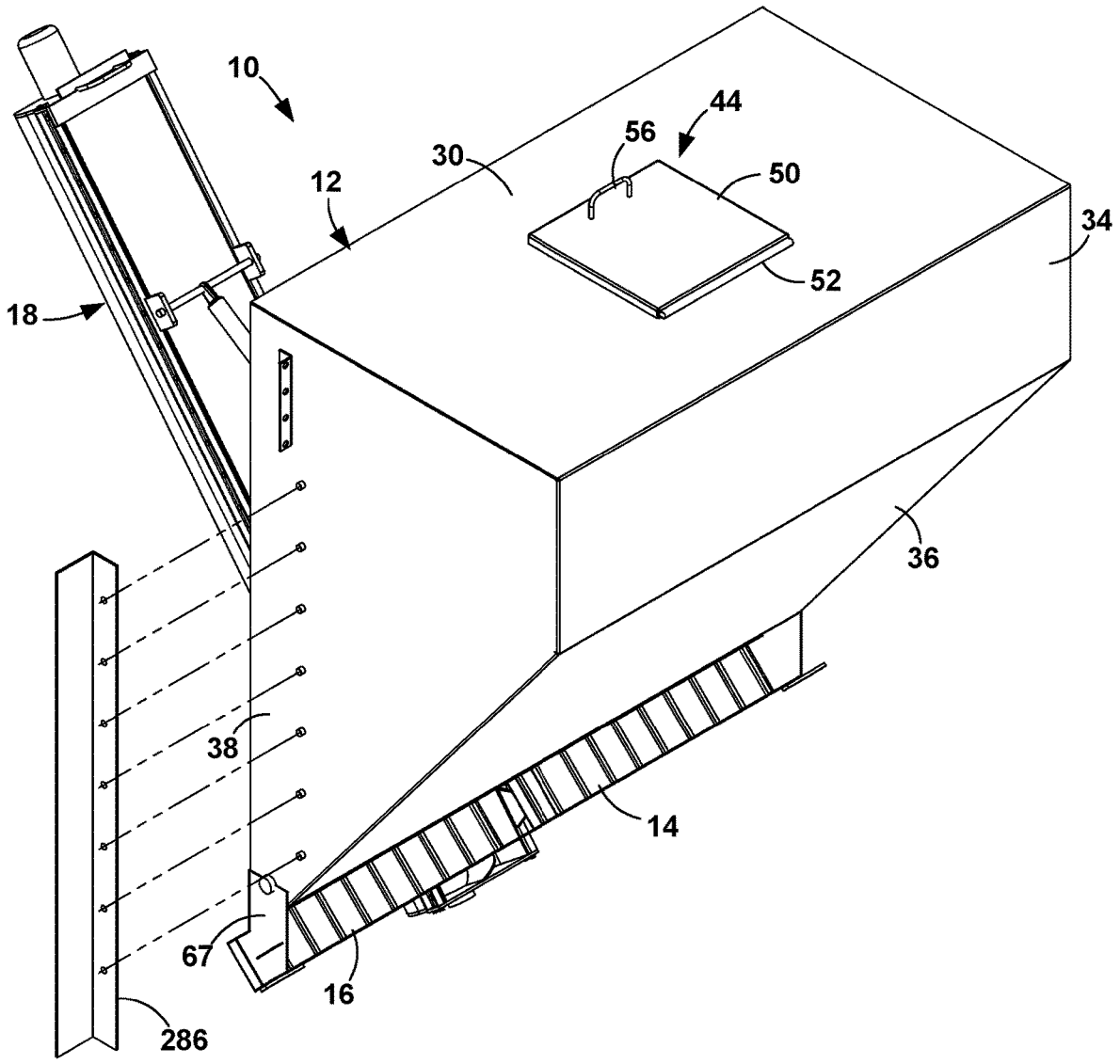
FIG. 10 is an upper, perspective view of the mixer.

The chute 18 is mounted, as at 130, to pivot vertically at a pivot end 128 between a storage position 110, shown in FIGS. 2 and 3, a discharge position 112, shown in FIG. 5, and a maximum position 114, shown in FIG. 9. In its simplest form, the pivot mount 130, shown in FIG. 21, includes a pair of generally triangular, vertical tabs 132 extending downwardly from the belt housing bottom wall 74 and a pair of generally triangular, vertical tabs 134 extending upwardly from the pivot end 128 of the chute 18. Each tab 132, 134 has a hole 136, 138 at its apex. The housing tab holes 136 are aligned with the chute tab holes 138 and bolts 140 are inserted through the aligned holes 136, 138 and secured with nuts 142. The bolts 140 operate as axes on which the chute tabs 134 pivot.

As previously described, the chute 18 pivots vertically between the storage position 110, the discharge position 112, and the maximum position 114. In the present design, the mechanism 180 for lifting and lowering the chute 18 includes a hydraulic piston 182. As shown in FIG. 7, the piston 182 is pivotally attached to the chute 18, as at 184, and pivotally attached to the front wall 32 of the hopper 12, as at 186.

In the storage position 110, the discharge end 144 is substantially higher than the pivot end 128 so that gravity prevents materials from exiting through the discharge end 144. Typically, for travel, the chute 18 will be generally parallel to the front wall 32, as in FIG. 2. Optionally, a chain, rope, or other strap can be used to tie the chute 18 to the hopper 12 or truck bed 3 during transport for more safety.

In the discharge position 112, the discharge end 144 is at or below the pivot end 128. The typical discharge position 112 is where the chute 18 is at about 45°-50° to the front wall 32, as in FIG. 5, depending on how far the truck bed 3 tilts up.

The maximum position 114 is the maximum angle of the chute 18 to the front wall 32. Typically, this will be about 90°, as shown in FIG. 9.

An inlet 146 in the chute ceiling 120 at the pivot end 128 is vertically aligned with the feed opening 102. As described above, the hopper auger assembly 60 feeds cement 4 into the hopper opening 65 where it falls into the feed belt gap 86 and into the feed opening 102, and the feed belts 14, 16 feed the mixing materials 5, 6 into the feed opening 102 in the belt housing 67. These dry materials, the cement 4 and mixing materials 5, 6, drop through the feed opening 102 into the chute feed inlet 146.

A mixing auger 150 extends through the trough 116 of the chute 18 for the length of the chute 18. The mixing auger 150 combines the dry materials and water to form the concrete 7 as they travel the length of the chute 18 from the chute feed inlet 146 to the discharge end 144, where the concrete mixture exits an opening 148 in the discharge end 144.

In the present design, the mixing auger shaft 152 has a diameter of 2½ inches, and the blade 154 has a height of 3-½ to 5 inches, for a total diameter of 9-½ to 12-½ inches. The peak-to-peak distance of the blades 64 is 9 to 10 inches and the blades 64 have a pitch of about 30°.

Figure 20:
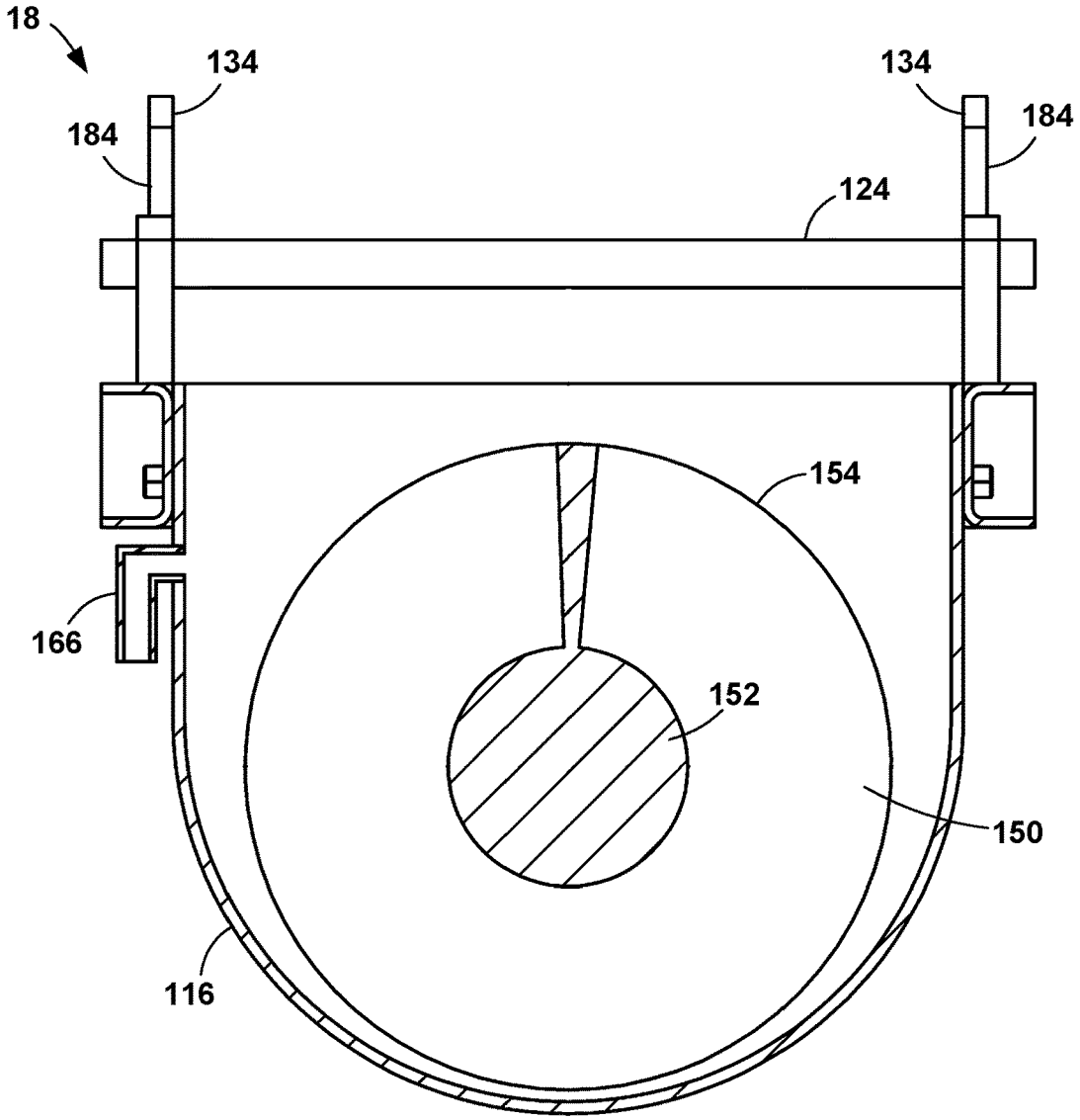
FIG. 20 is a lateral cross-sectional view of the chute.
Figure 21:
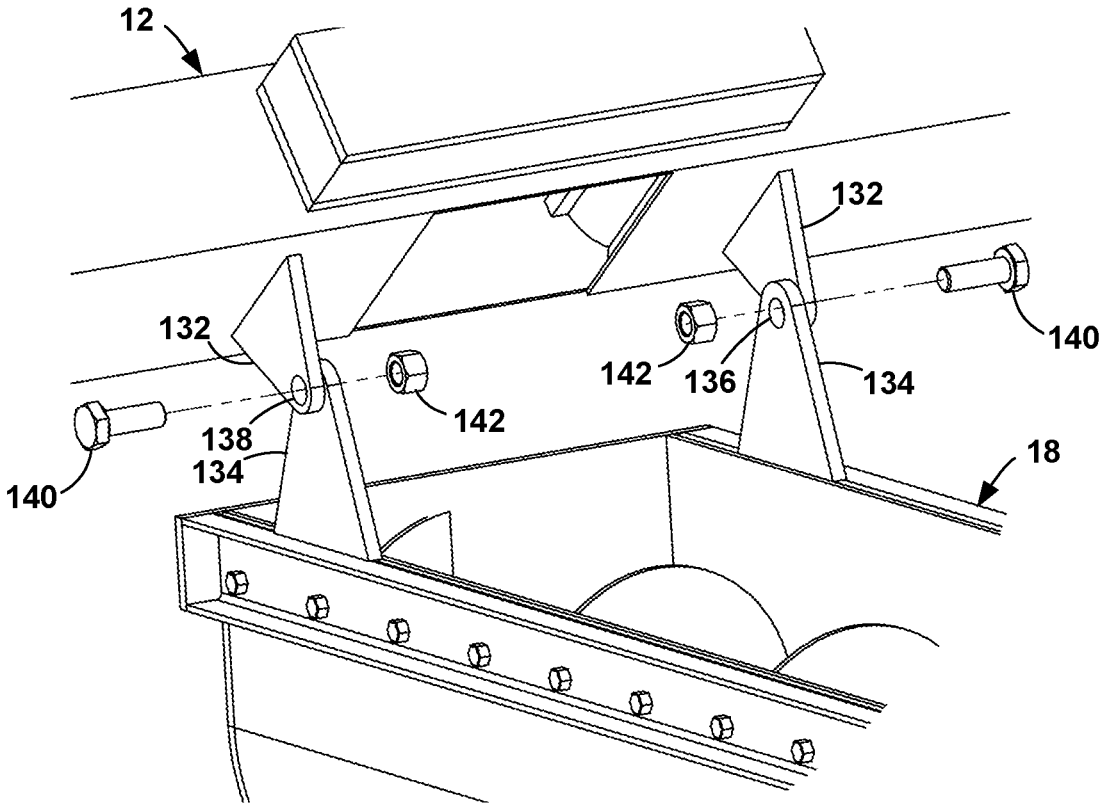
FIG. 21 is a detail, perspective view of the chute pivot mount.

Water is added to the chute 18 at a distance of about ¼ the length of the mixing auger 150 from the pivot end 128. This permits the dry materials to be mixed before the water is added. The remainder of the ¾ of the mixing auger 150 mixes the dry materials and water together for proper hydration of the concrete 7. As shown in FIGS. 5 and 20, the water is added to the chute 18 at a water inlet 166 in the trough 116 via a water hose with a water control valve that can be regulated manually or electronically for the proper amount of water. The water is supplied to the hose from the job site or from a water tank mounted on the truck.

Figure 22:
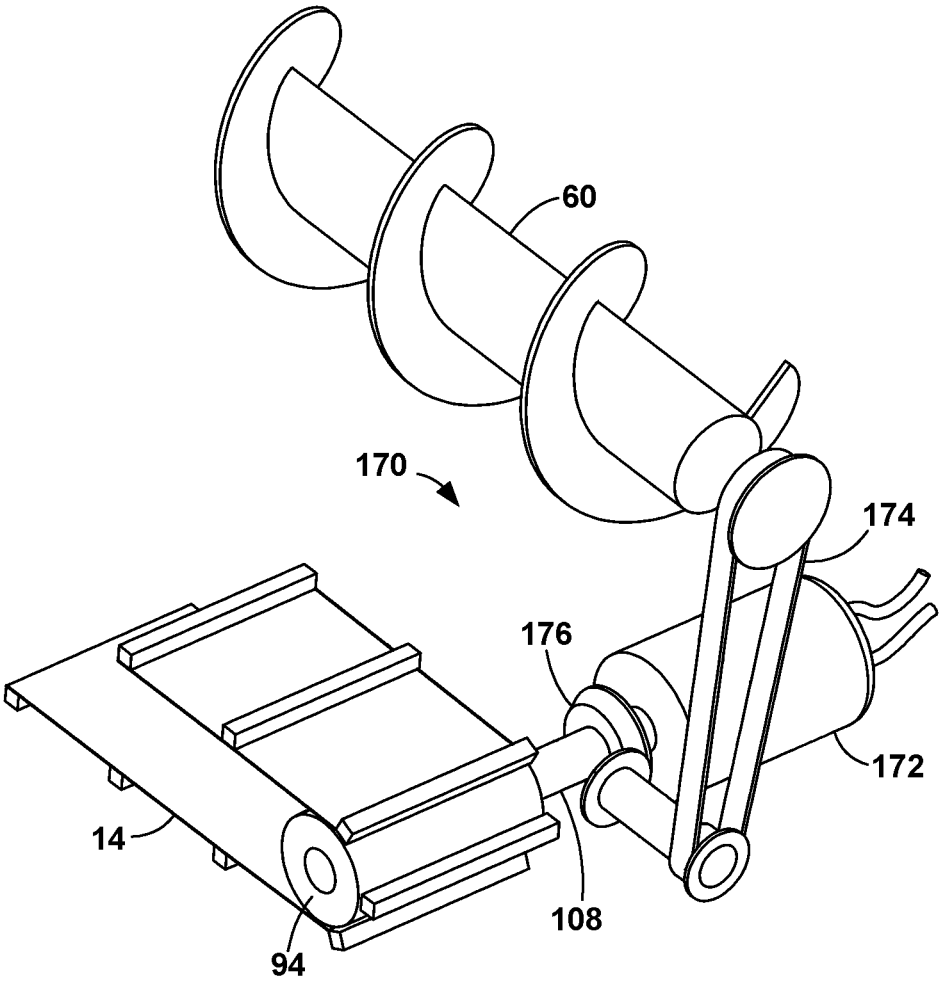
FIG. 22 is a perspective view of a basic drive mechanism.

The hopper auger assembly 60 and feed belts 14, 16 are driven by a drive mechanism 170, a typical configuration of which is shown in FIG. 22. The basic drive mechanism 170 of FIG. 22 includes a hydraulic motor 172 that directly drives the feed belts 14, 16 and that uses right-angle gearing 176 from the motor 172 to drive a drive belt or chain 174 to rotate the hopper auger assembly 60. Alternatively, the hydraulic motor 172 can be replaced by a single electric motor or by multiple electric motors.

The mixing auger 150 is driven by a hydraulic motor 156, preferably mounted at the discharge end 144 of the chute 18.

Figure 23:
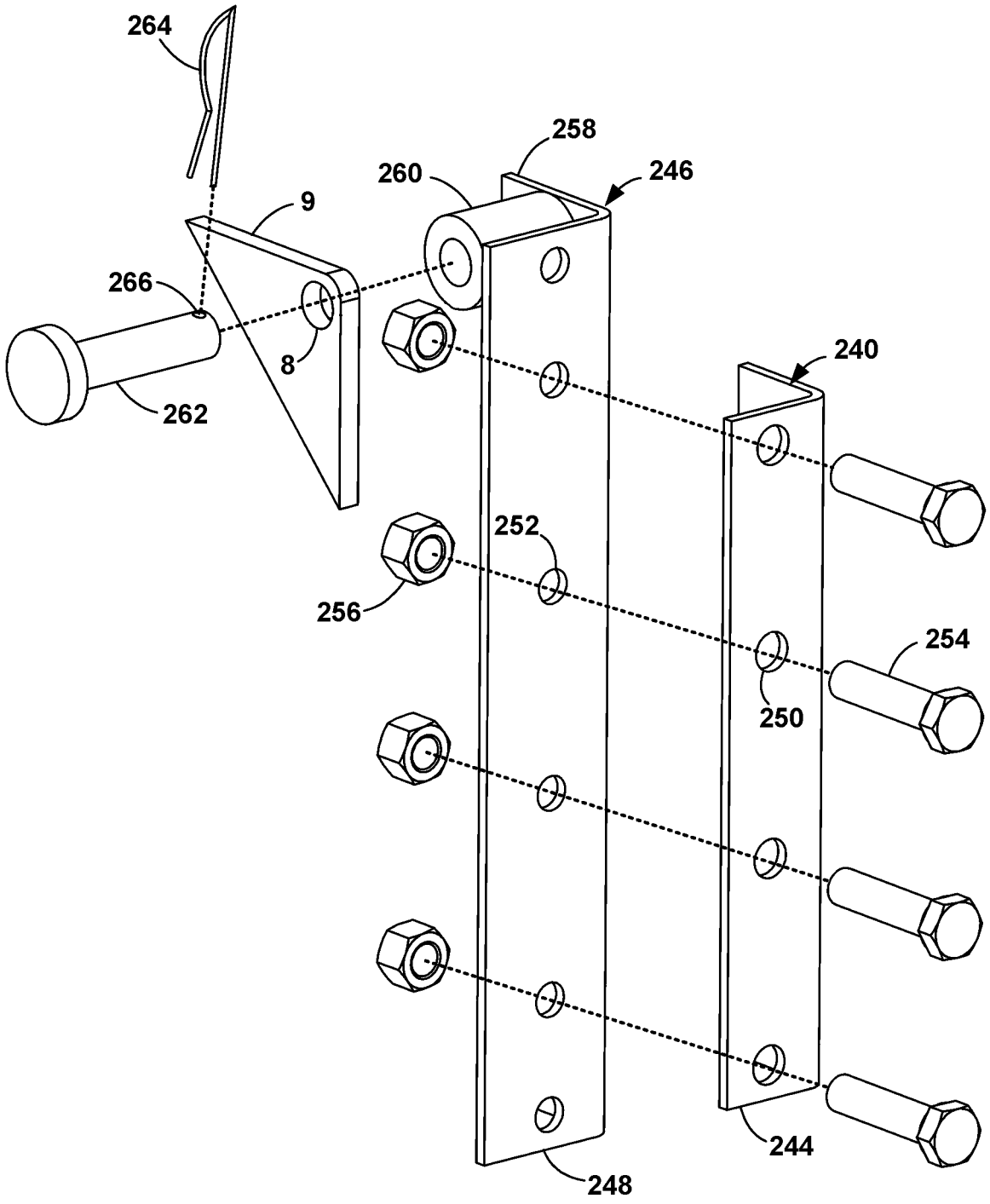
FIG. 23 is an exploded view of the upper attachment of the mixer to the dump truck bed.

The mixer 10 is mounted in the truck bed 3 and is generally attached in the same manner as a tailgate. Optionally, the mixer 10 has hooks or eyelets at the top so that the mixer 10 can lifted by crane or other lifting machine. The upper attachment is shown in FIG. 23. Only one side of the hopper 12 is shown and the other side of the hopper 12 has an attachment that is the mirror image of that shown in FIG. 23. One side 242 of a hopper bracket 240, which is a 90° angle iron, is attached vertically to the hopper 12. One side 248 of a bed bracket 246, also a 90° angle iron, nests against the other side 244 of the hopper bracket 240. A series of holes 250 in the hopper bracket 240 align with a series of holes 252 in the bed bracket 246. Bolts 254 and nuts 256 through the holes 250, 252 secure the bed bracket 246 to the hopper bracket 240. The holes 250, 252 are organized so that the bed bracket 246 can be attached higher or lower to adjust for different truck bed heights. There can be more bed bracket holes 252 than hopper bracket holes 250, as in FIG. 23, more hopper bracket holes 250 than bed bracket holes 252, or the same number of holes 250, 252 in the brackets 240, 246 with less than all of the holes 250, 252 aligning.

The other side 258 of the bed bracket 246 has a cylindrical spacer 260 extending perpendicularly from the side of the hopper 12. The spacer 260 aligns with the hole 8 in the truck bed wall 9 that normally holds the tailgate. A pin 262 extends through the bed hole 8 and the spacer 260 and is secured by a hairpin cotter pin 264 or the like through a radial hole 264 in the pin 262. Optionally, the spacer 260 is swappable so that spacers 260 of the appropriate length for the hopper/truck bed wall gap 284 can be used.

For the lower attachment, pins or flat bars 270 are welded horizontally to the feed belt housing back wall 68 so that they extend outwardly from the end walls 76, as seen in FIG. 18. The pins 270 are captured by the truck 2 in the same manner that the corresponding pins on a tailgate are captured.

Thus, it has been shown and described a mobile continuous mixing apparatus. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A mobile continuous mixing apparatus adapted to be received by the bed of a dump truck, the apparatus comprising:

(a) a hopper designed to hold cement and having a bottom and front wall;

(b) a rotating hopper auger assembly at the hopper bottom designed to move the cement toward an opening in the bottom of the hopper;

(c) a pair of feed belts within a belt housing below the hopper and designed to be open to the truck bed, the belts extending in a direction parallel to the hopper front wall, linearly aligned, and separated by a gap aligned with the opening in the hopper, the belts designed to feed materials from the truck bed to the gap where the feed materials fall to a feed opening that is below and aligned with the opening in the hopper;

(d) a chute having a pivot end and a discharge end, the chute comprising an elongated trough and a rotating mixing auger within the trough, the chute mounted to pivot vertically about the pivot end between a storage position, wherein the discharge end is higher than the pivot end, and a discharge position, wherein the discharge end is at or lower than the pivot end, the chute having a materials inlet at the pivot end below and aligned with the feed opening, a mixture discharge opening at the discharge end, a water inlet into the trough, the chute auger designed to mix and move materials from the materials inlet and the water to the discharge opening; and (e) drive mechanisms for rotating the hopper auger assembly, feed belts, and mixing auger.

2. The mobile continuous mixing apparatus of claim 1 further comprising one or more vibrators attached to the hopper and designed to help maintain a continuous flow of cement in the hopper to the hopper auger assembly.

3. The mobile continuous mixing apparatus of claim 1 wherein the hopper auger assembly has a single shaft and a pair of blades with opposite twist designed to move the cement toward the opening in the center of the hopper bottom.

4. The mobile continuous mixing apparatus of claim 1 wherein the center portion of the hopper auger assembly is within a pipe that has an opening aligned with the hopper opening.

5. The mobile continuous mixing apparatus of claim 1 wherein each belt is composed of a flexible material with lateral cleats.

6. The mobile continuous mixing apparatus of claim 1 further comprising a limiting gate for each belt designed to control the amount of material reaching the feed opening.

7. The mobile continuous mixing apparatus of claim 6 wherein the limiting gates are part of a generally pyramid-shaped cover over the feed opening.

8. The mobile continuous mixing apparatus of claim 1 wherein the belts are tilted downwardly at an angle in the range of 135°±15° from the front wall of the hopper.

9. The mobile continuous mixing apparatus of claim 1 further comprising an emptying mechanism including a hatch at each end of the belt housing whereby, when the belts are run away from the feed opening, the materials are fed to the hatches.

10. The mobile continuous mixing apparatus of claim 1 wherein the water inlet is approximately ¼ of the way from the pivot end to the discharge end of the chute.

11. The mobile continuous mixing apparatus of claim 1 wherein the hopper assembly is parallel to the front wall of the hopper.

* * * * *